US011484928B2

(12) United States Patent
Wolf

(10) Patent No.: US 11,484,928 B2
(45) Date of Patent: Nov. 1, 2022

(54) BENDING MACHINE FOR BENDING ROD-SHAPED OR TUBULAR WORKPIECES

(71) Applicant: WAFIOS Aktiengesellschaft, Reutlingen (DE)

(72) Inventor: Juergen Wolf, Walddorfhaeslach (DE)

(73) Assignee: WAFIOS Aktiengesellschaft, Reutlingen (DE)

( * ) Notice: Subject to any disclaimer, the term of this patent is extended or adjusted under 35 U.S.C. 154(b) by 289 days.

(21) Appl. No.: 16/635,443

(22) PCT Filed: Jun. 25, 2018

(86) PCT No.: PCT/EP2018/066866
§ 371 (c)(1),
(2) Date: Jan. 30, 2020

(87) PCT Pub. No.: WO2019/029893
PCT Pub. Date: Feb. 14, 2019

(65) Prior Publication Data

US 2021/0086246 A1 Mar. 25, 2021

(30) Foreign Application Priority Data

Aug. 8, 2017 (DE) ..... 10 2017 117 979.8

(51) Int. Cl.
*B21D 7/02* (2006.01)
*B21D 7/024* (2006.01)
*B21D 11/10* (2006.01)

(52) U.S. Cl.
CPC ..... *B21D 7/021* (2013.01); *B21D 7/024* (2013.01); *B21D 11/10* (2013.01)

(58) Field of Classification Search
CPC ..... B21D 7/21; B21D 7/24; B21D 11/10
(Continued)

(56) References Cited

U.S. PATENT DOCUMENTS 5,495,740 A 3/1996 Schwarze
2004/0200252 A1* 10/2004 Schmauder ..... B21D 7/024 72/149

(Continued)

FOREIGN PATENT DOCUMENTS

DE 1 652 817 4/1971
DE 93 16 052 U1 1/1994

(Continued)

*Primary Examiner* — Jessica Cahill
*Assistant Examiner* — Smith Oberto Bapthelus
(74) *Attorney, Agent, or Firm* — Christensen, Fonder, Dardi & Herbert PLLC

(57) ABSTRACT

A bending machine for elongated workpieces, comprising a bending tool with a bending head having a bending disc with a bending groove and two slide rails, each having a molding groove and which can be placed laterally against opposing sides of the workpiece. Each slide rail is secured to a support part and laterally supports the workpiece from where the workpiece is fed into the bending groove to a point in front of the bending groove when the slide rail is resting against the workpiece. Each support part is adjustable between a starting position, in which the slide rail does not rest against the workpiece, and a final position, in which the slide rail contacts the workpiece. Upon contacting the workpiece, the other slide rail assumes its starting position. The support parts are attached to a two-arm lever, and a slide piece rests against the workpiece in each lever position.

16 Claims, 8 Drawing Sheets

(58) Field of Classification Search
USPC ..... 72/149
See application file for complete search history.

(56) References Cited

U.S. PATENT DOCUMENTS

| | | | |
|---|---|---|---|
| 2005/0172690 | A1 | 8/2005 | Cappello et al. |
| 2005/0217337 | A1 | 10/2005 | Bruyas et al. |
| 2005/0235720 | A1 | 10/2005 | Yogo |
| 2010/0095732 | A1 | 4/2010 | Wolf |
| 2014/0326033 | A1 | 11/2014 | Caporusso |

FOREIGN PATENT DOCUMENTS

| | | | |
|---|---|---|---|
| DE | 602 18 339 | T2 | 11/2007 |
| EP | 1 595 612 | A1 | 11/2005 |
| EP | 1 458 505 | B1 | 2/2007 |
| EP | 2 177 287 | A2 | 4/2010 |
| EP | 2 756 891 | A1 | 7/2014 |
| GB | 1 257 253 | | 12/1971 |
| WO | WO 2004/000479 | A1 | 12/2003 |

* cited by examiner

BENDING MACHINE FOR BENDING ROD-SHAPED OR TUBULAR WORKPIECES

PRIORITY CLAIM

The present application is a National Phase entry of PCT Application No. PCT/EP2018/066866, filed Jun. 25, 2018, which claims priority from German Patent Application 10 2017 117 979.8, filed Aug. 8, 2017, the disclosures of which are hereby incorporated by reference herein in their entirety.

FIELD OF THE INVENTION

The invention relates to a bending machine for bending rod-shaped or tubular workpieces, comprising a bending tool which comprises a bending head with a bending disk comprising at least one circumferential bending groove, and additionally comprising two slide rails, each of which has a molding groove and which can be placed laterally against opposing longitudinal sides of the workpiece, wherein each slide rail is secured to a support part and laterally supports the workpiece in a region from where the workpiece is tangentially fed into the bending groove of the bending disk to a point in front of the bending groove at a specified distance therefrom when the slide rail is resting against the workpiece, and wherein each support part can be adjusted between a starting position, in which the associated slide rail does not rest against the workpiece, and a final position, in which the slide rail contacts the workpiece, wherein, upon contacting of one slide rail with the workpiece, the other slide rail assumes its respective starting position.

BACKGROUND OF THE INVENTION

DE 93 16 052.6 U1 describes a pipe bending machine that can be used for bending pipes to the left or right. Two separate slide rail devices are used on both sides of the longitudinal axis of the pipe to be handled, each of which can be moved in parallel to the direction of movement of the workpiece and horizontally (perpendicularly) to the workpiece. Each slide rail device can move independently of the other slide rail device. In addition, the slide rails cannot be moved vertically in order to maintain smaller interfering contours with a larger bending clearance.

Similarly, in the pipe bending machine according to EP 1 458 505 B1 or DE 602 18 339 T2, which also permits left and right bending, slide rail devices are provided on both sides of the workpiece. These can be moved in parallel to the workpiece independently of each other and together with one another perpendicular to the workpiece. However, the slide rails are not intended to move vertically here either.

An additional bending machine for left and right bending of elongated workpieces is described in EP 1 595 612 A1, in which separate slide rails for left and right bending can in turn be swiveled using a pivot movement from a position lowered below the bending plane and away from the workpiece to a raised position resting against the workpiece. In this publication, however, the slide rails are not intended to move in parallel to the workpiece or vertically.

The machine for bending pipe coils from DE 1 652 817 A1 specifies slide rails that can be moved both vertically and in the direction of movement of the workpiece. Here, however, a horizontal movement perpendicular to the workpiece is not expressly described, only a lifting of the slide rails from the workpiece is indicated.

On the other hand, slide rails that can be moved together perpendicular to the workpiece are used in the bending arrangement for pipes shown in WO 2004/000479 A1. Such rails can also be moved independently of each other and in parallel to the workpiece. In this familiar arrangement, however, there are clear interfering contours with only moderate bending clearance.

A bending machine of the aforementioned type is known from EP 2 177 287 A2. There, the slide rails mounted on both sides of the workpiece can be moved in parallel to the workpiece, wherein a vertical or a perpendicular movement to the workpiece is not provided. This known bending machine also allows left and right bending, wherein material from the coil is processed, not cut-to-length pipe sections. However, when bending pipes with a pipe gripper feed and a cut-to-length workpiece, collisions can occur in this known bending machine.

SUMMARY OF THE INVENTION

Starting therefrom, the object of the invention is to improve this known pipe bending machine in such a way that it has fewer interfering contours with greater bending clearance and can be used without problems for machines with cut-to-length workpieces as well as for material from coils.

According to the invention, this is achieved in a bending machine of the type mentioned in the introduction in that the two support parts are mounted mirror-inverted to one another at the ends of a pivotably mounted, two-arm lever, wherein in each final pivot position of the lever, one of the two slide pieces rests laterally against the workpiece with its molding groove.

In the invention, the slide rails are not moved over guides on which longitudinal and transverse slides are mounted, but instead by means of a two-arm lever pivotably mounted on the machine. This allows the slide rails to be pivoted in contact to the right and left of the bending head, which proves to be particularly suitable for right and left bending. It is advantageous that the slide rails can also be moved in the direction of movement of the workpiece, wherein the bending head is also preferably arranged so that it can be moved vertically and horizontally.

The bending machine according to the invention is particularly advantageous for bending thin-walled pipes in order to be able to bend them without an internal mandrel. It is also possible to bend aluminum pipes and stainless-steel pipes without cold welding, since the clamping jaw opens horizontally before turning back at the end of the bending and no longer rests against the workpiece.

Compared with bending machines that work without slide rails and with counterholder rollers, the bending machine according to the invention has the advantage that the counterholder rollers are always arranged further away from the bending center than slide rails and thus the bending quality is not as high as the bending quality that can be achieved with the bending machine according to the invention.

A completely new concept of the arrangement of the slide rails is used in the bending machine according to the invention, since slide carriages with linear guides are no longer used for the feed movement of the slide rails toward and away from the workpiece. The attachment of the slide rails to the ends of a two-arm lever allows, by virtue of a relatively rapidly implementable pivoting movement, quick pivoting from right to left bending (and vice versa) and thus makes it possible to reduce downtime in the bending machine according to the invention.

The pivotability of the two-arm lever with the slide rails also makes it possible to rotate it into a central position, in which neither of the two slide rails rests laterally against the workpiece, with both slide rails remaining detached from it. Such a central position is relevant, for example, for the last bend on a workpiece, because short end straight lines can be achieved on this workpiece. In such a central position of the lever, the pipe gripper, which holds the workpiece, can move forward into the tool area and transfer the workpiece, which is then held by the bending tool and clamping jaws. The gripper can then move back without the workpiece, after which the relevant slide rail is placed against the workpiece and the last bend is created on it.

By means of a suitably designed two-arm lever, it can be ensured that, when a slide piece is placed laterally on the workpiece to be handled, the other slide piece is brought into a starting position lying clearly below the bending plane and thus, in the area of the bending plane and above it, there are no interfering contours caused by this lowered slide rail, thus ensuring a large bending clearance.

In a preferred embodiment of the invention, the pivotably mounted lever is mounted between a workpiece guide on the machine frame and the bending tool 34. The lever can advantageously be pivotably mounted on a bracket that is attached to the machine housing, preferably at the front of the machine frame, or pivotably fastened to the bending head, and can also be moved horizontally (perpendicular to the longitudinal axis of the workpiece).

The two-arm pivotable lever can be designed in any suitable shape for this, but a V or C shape is particularly preferable.

It has proved to be particularly advantageous if the slide rails on the two-arm lever are arranged inclined at an angle of 60° to each other, which makes it possible for a relatively short distance to be covered in order to pivot from right to left bending (and vice versa), which also has a very favorable effect on non-productive times. On the other hand, the lever arms should also be as far apart as possible in order to ensure the greatest possible bending clearance.

In certain applications, however, it is also very useful to use a smaller angle of about 45° or, especially preferably, 90° for the adjustment of the slide rails relative to each other.

It is advantageous in the invention that each slide rail is provided on the associated support part so that it can be moved in parallel to the longitudinal direction of the workpiece. When a slide rail is applied, the friction force pulls the slide rail along with the movement of the workpiece in its longitudinal direction until its bending is completed, after which the slide rail must be returned to its original position.

For this purpose, each slide rail is advantageously seated on a tool holder, which is mounted on the associated support part and which in turn can be moved in parallel to the longitudinal direction of the workpiece via a linear guide on the lever, an adjustable stop being again preferably provided on the linear guide, by means of which a desired starting position of the slide rail, viewed in the longitudinal direction, can be fixed. For the return of the slide rail to its starting position after bending, it is advantageous if each slide rail is spring-preloaded in the linear guide in the direction of the adjustable stop. Instead of using an elastic spring, this can also be done by pneumatic or electrical means.

If the bending machine according to the invention is used to process cut-to-length workpieces, it is particularly advantageous if the workpiece feed is provided in the form of a gripper guide.

It is also advantageous if the bending head can be moved laterally and/or vertically relative to the machine frame.

The bending machine according to the invention can be used both for processing material from coils and for processing cut-to-length pipe sections. It has few interfering contours with a particularly large bending clearance and permits a rapid changeover from right to left bending (and vice versa), so that the non-productive times are also relatively short.

BRIEF DESCRIPTION OF THE DRAWINGS

The invention will be explained in more detail below in principle by way of example on the basis of the drawings.

DETAILED DESCRIPTION

The following figure description shows an embodiment of a pipe bending machine as claimed in this invention, wherein the same numerals are used for the same parts in different figures.

Figure 1:
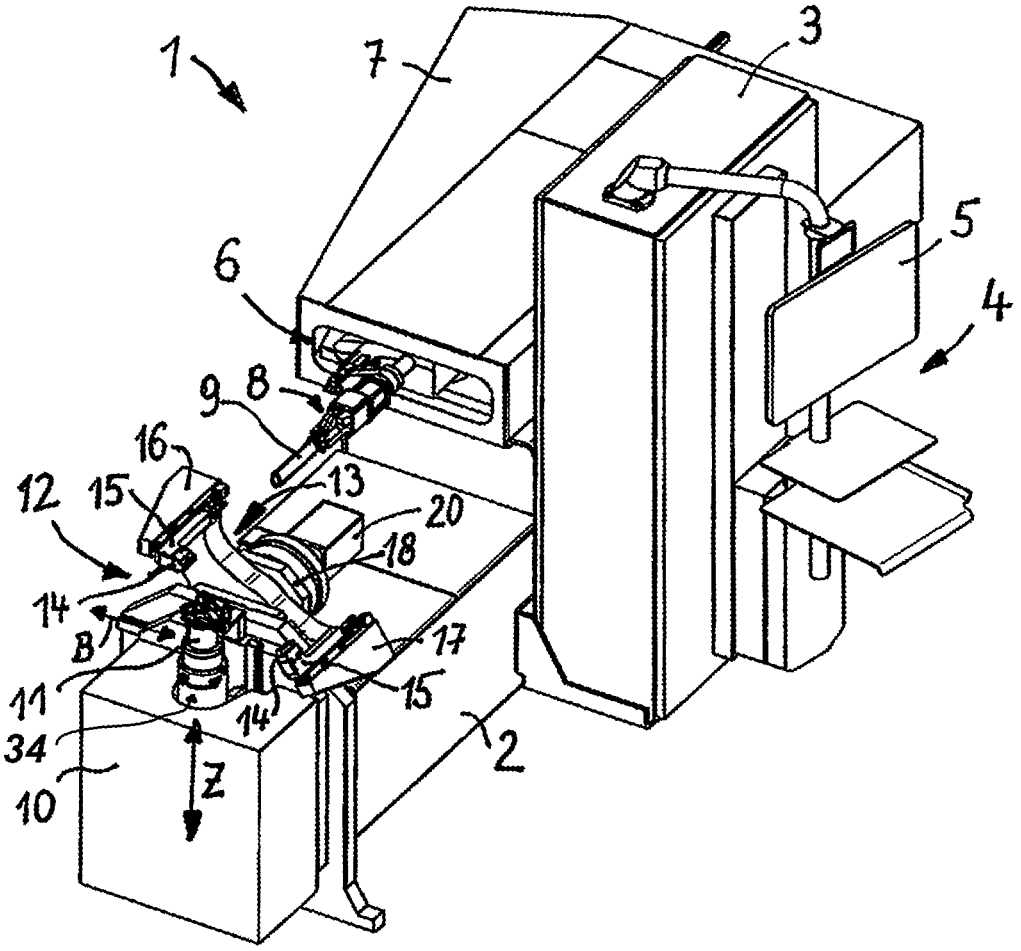
FIG. 1 shows a perspective view of a pipe bending machine according to the invention with pipe gripper guide, wherein a bending unit with bending head and with slide rails attached to a pivotable lever is arranged at the front end of the machine frame.

FIG. 1 shows a perspective view (from the front and from diagonally above) of a pipe bending machine 1 with a machine frame 2, on the side of which a switch cabinet 3 with a control panel 4 and a screen 5 for operating the pipe bending machine 1 is mounted.

A spindle arrangement 6 with a protective hood 7 is assigned to the machine frame 2, wherein a pipe gripper 8 is provided here for holding and feeding as well as for rotating a cut-to-length workpiece 9 (pipe) about its longitudinal axis.

Furthermore, a bending unit 10 with a bending head 11 is attached to the front end face of the machine frame 2, wherein the bending unit 10 is movable both in a vertical (Z-axis) and perpendicular (B-axis) direction to the direction of movement of the workpiece 9 (the directions of movement are shown in FIG. 1 by the arrows associated with the bending unit 10).

Figure 2:
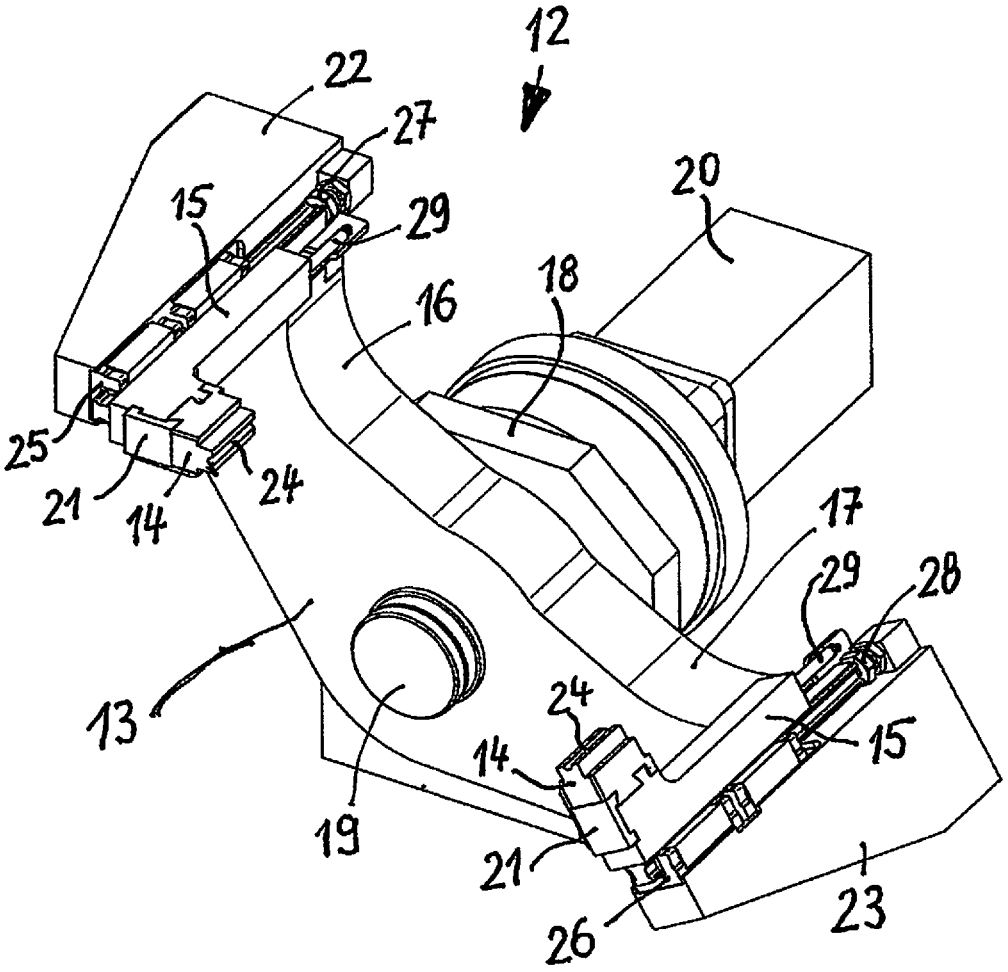
FIG. 2 shows a view from a diagonal perspective (from above) of the pivotable lever device for the slide rails with a bracket for attachment to the machine frame.

In the embodiment shown here, a pivotable lever device 12 is attached to the machine frame 2, which device is shown in more detail in a perspective view in FIG. 2:

This lever device 12 is substantially formed by a two-arm lever 13, which is attached to a bracket 18 such that it is pivotable via a bearing pin 19, the pivot point of which also represents the pivoting axis for the lever 13. As FIG. 2 shows, the lever 13 is located at the front of the bracket 18, at the rear of which the two-arm lever 13 is connected via a gearbox to a servomotor 20, via which the drive for the pivoting movements of the lever 13 is generated.

The lever 13 has a lever arm 16 on one side (shown on the left in FIG. 2) for left bending and a lever arm 17 on its other side for right bending.

At the end of the lever arm 16 for left bending, a support part 22 is formed and at the end of the lever arm 17 for right bending, a support part 23 is formed, to which in each case a linear guide 25 or 26 is fastened, in which in each case a displaceable tool holder 15 is located, to which a slide rail 14 is fastened via a clamp 21.

The movement of the tool holders 15 in the linear guides 25 and 26 and thus the movement of the slide rails 14 takes place in a direction parallel to the longitudinal direction of the workpiece 9 to be processed.

The linear guides 25 and 26 each have an adjustable stop 27 and 28 respectively, which in the exemplary embodiment shown is mounted in the form of a rotatable nut and by means of which the starting position of the slide rail 14 of the respective lever arm 16 and 17 can be adjusted. Such a positioning is necessary because the slide rail 14 must be adapted to the position of the workpiece 9 to be bent in accordance with the bending step to be carried out. In addition, this function is essential if a cut-to-length pipe is to be bent which has already been processed at its end (e.g. an end reshaping or a fitted nut) and the inner contour of the slide rail 14 has a certain shape (groove, slot, etc.). Due to the frictional force that occurs when the slide rail 14 contacts the workpiece 9, the slide rail 14 is pulled along by the workpiece 9 during the corresponding bending step until the bending is complete, after which the slide rail 14 must be returned to its starting position again. Such a return to the starting position can be achieved by the slide rail 14, as shown in FIG. 2 for instance, using suitable preloading springs 29, but could also be suitably controlled pneumatically or electrically. The entire lever device 12 with the individual elements attached to it represents an assembly which could also be described as a pivotable support device or as a counterholder unit.

FIGS. 3*a*, 3*b*, 4*a*, 4*b* as well as 5*a* and 5*b* show the bending machine 1 according to the invention in different positions of the lever device 12, which can or must be approached during a working cycle of the bending machine 1.

Figure 3A:
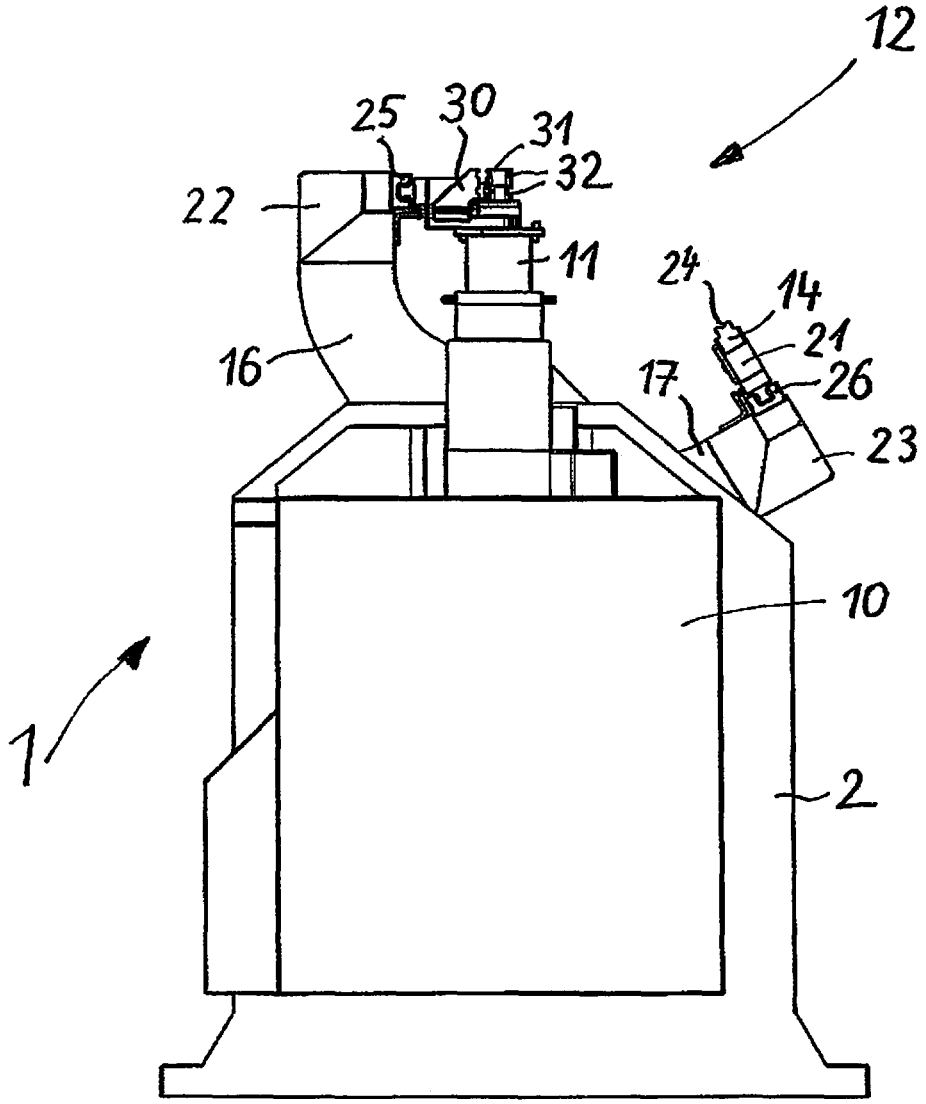
FIG. 3*a* in front view and FIG. 3*b* in plan view show a bending machine according to the invention in a position for left bending.
Figure 3B:
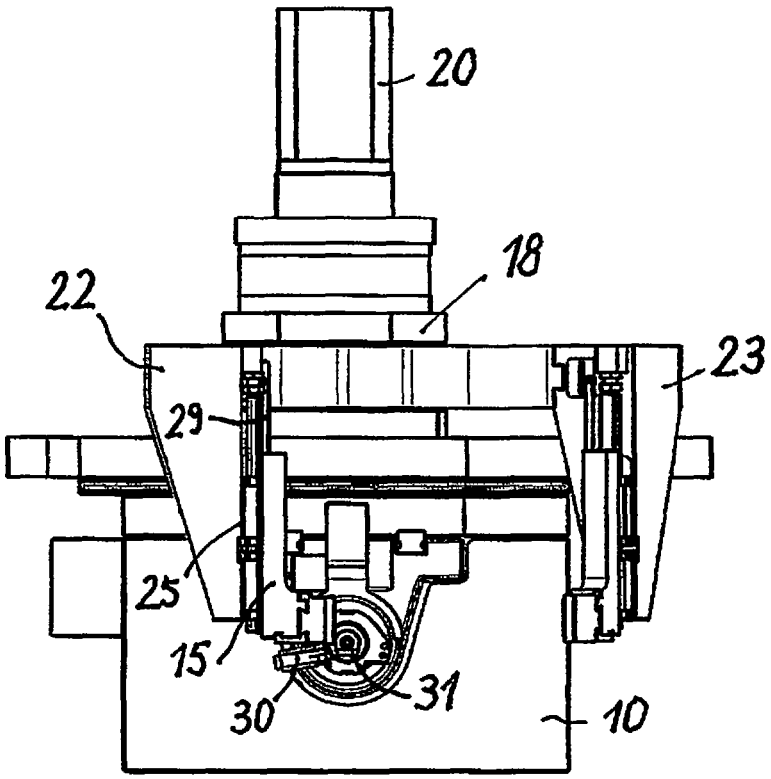
FIGS. 3 to 5 show representations of different positions of the lever device carrying the slide rails as they are (or can be) approached during the working cycle of the bending machine.

Thus FIG. 3*a* shows a front view of a pipe bending machine 1 and FIG. 3*b* a plan view of the latter in a position which is intended for left bending, wherein in both figures (as also in the following figures) the workpiece is not shown.

The workpiece is fed to the bending unit 10 via the feed, such as a pipe gripper feed, and threaded between a clamping jaw 30 and the bending mold 31 and clamped in place by these. The lever device 12 then pivots up to the right (seen in the longitudinal direction of the workpiece 9 to be processed), cf. FIG. 3*a*, and the slide rail 14 of the lever arm 16 for left bending is in contact with the workpiece. During the subsequent bending process, the lever device 12 serves as the corresponding support device or counterholder unit for the workpiece to be processed. As already mentioned, the friction force pulls the slide rail 14 along with the forward moving workpiece 9 until the bend is completed. Then, when the slide rail 14 is lifted off the side of the workpiece 9, the support part 22 holding the slide rail 14 is pushed back again into its starting position via the preloaded spring 29.

It should be noted here that on each slide rail 14, on its side facing the workpiece 9, a molding groove 24 is mounted, which runs parallel to the longitudinal direction of the workpiece 9 and, when the slide rail 14 rests against the side of the workpiece 9 to be supported, comes into contact with its outer circumference. Similarly, at least one (in the figures: two) bending groove 32 is also mounted on to the bending mold 31.

Figure 4A:
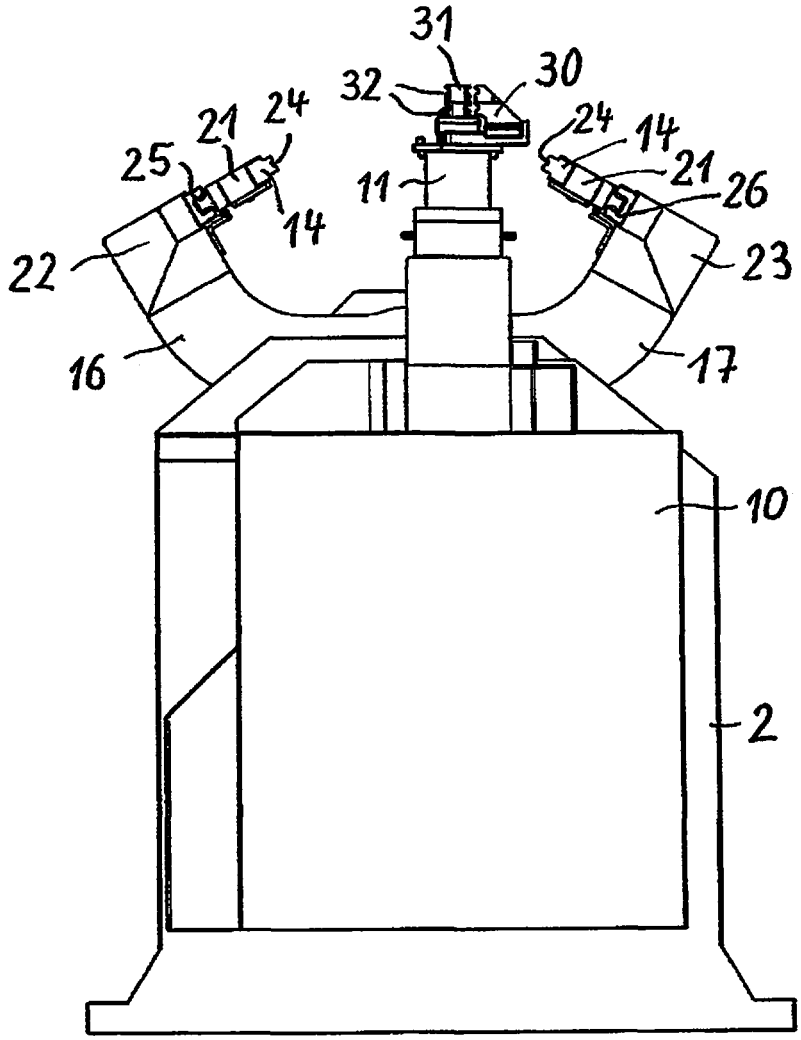
FIG. 4*a* in front view and FIG. 4*b* in plan view show a bending machine according to the invention, in which the two-arm lever carrying the slide rails is in a central position in which no slide rail rests against the workpiece to be processed, and FIG. 5*a* in front view and FIG. 5*b* in plan view show a bending machine according to the invention in a position for right bending.
Figure 4B:
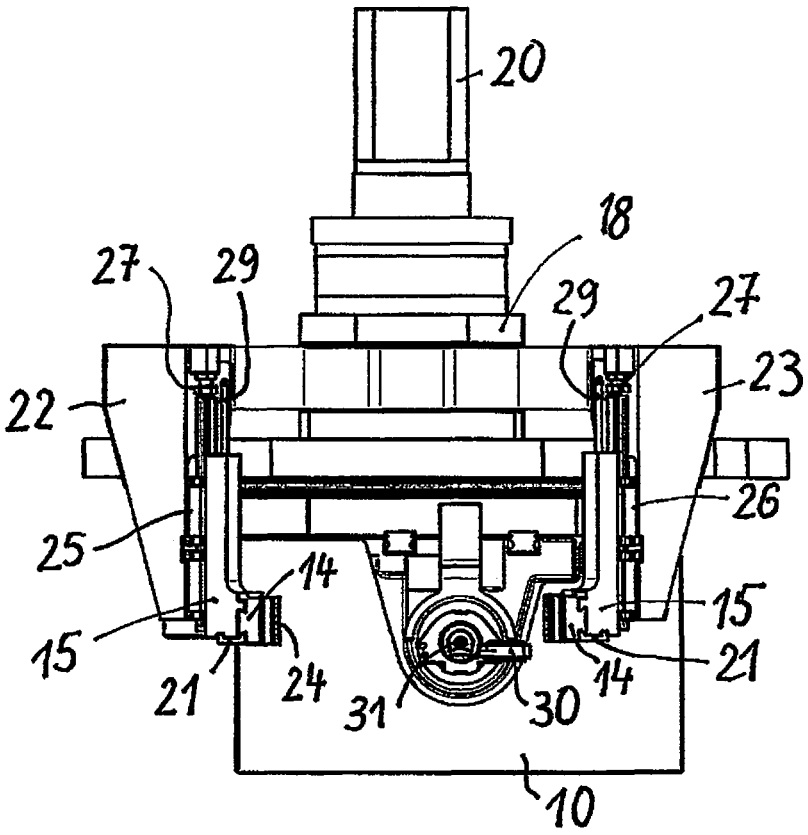

In the illustrations in FIGS. 4*a* and 4*b*, the lever device 12, viewed in the feed direction of the workpiece 9, has been pivoted clockwise and assumes a central position in which neither of the two lateral slide rails 14 comes into lateral contact with a workpiece 9.

This central position, as shown in FIGS. 4*a* and 4*b*, is crossed when changing from right bending to left bending (or vice versa). It is also essential for making a final bend on the workpiece 9 to the extent that short straight lines at the end can be produced as a result. When the lever 13 is in this central position, the workpiece 9 held by a pipe gripper 8, for example, can be moved forward from the latter into the tool area and picked up and held there between the clamping jaws 30 and the bending mold 31. The pipe gripper 8 then moves back without the workpiece 9, after which the slide rail 14 is placed on the side of the workpiece and the last bend is initiated.

Figure 5A:
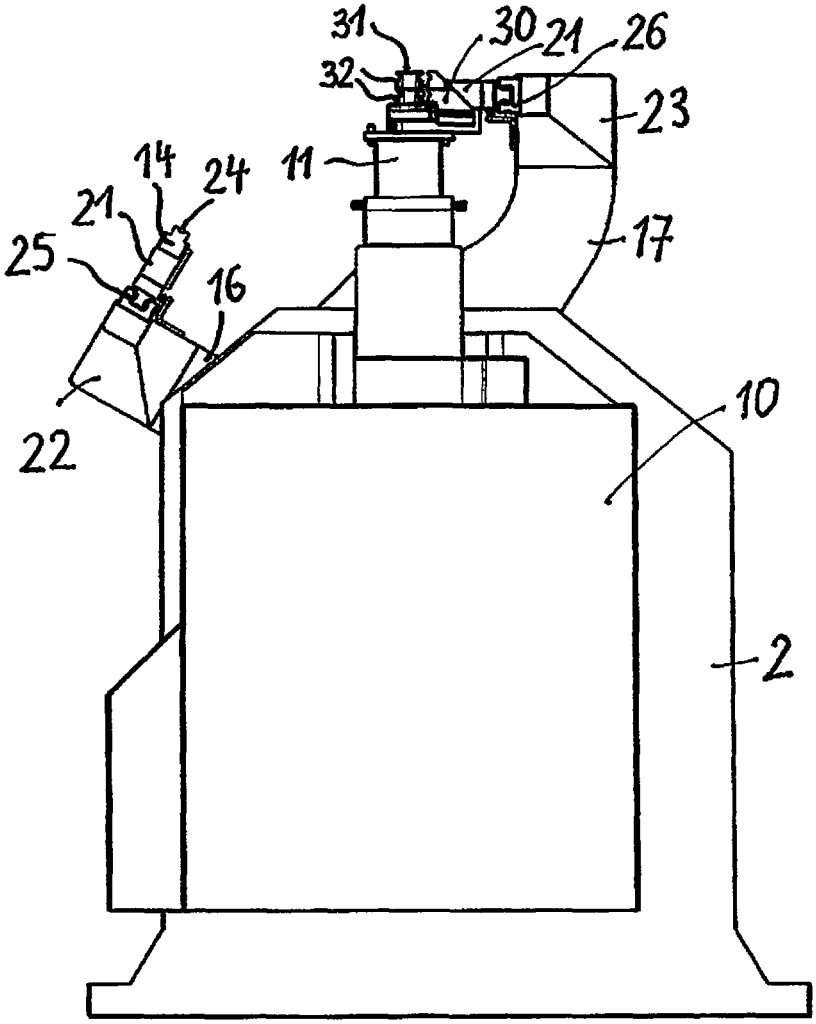
Figure 5B:
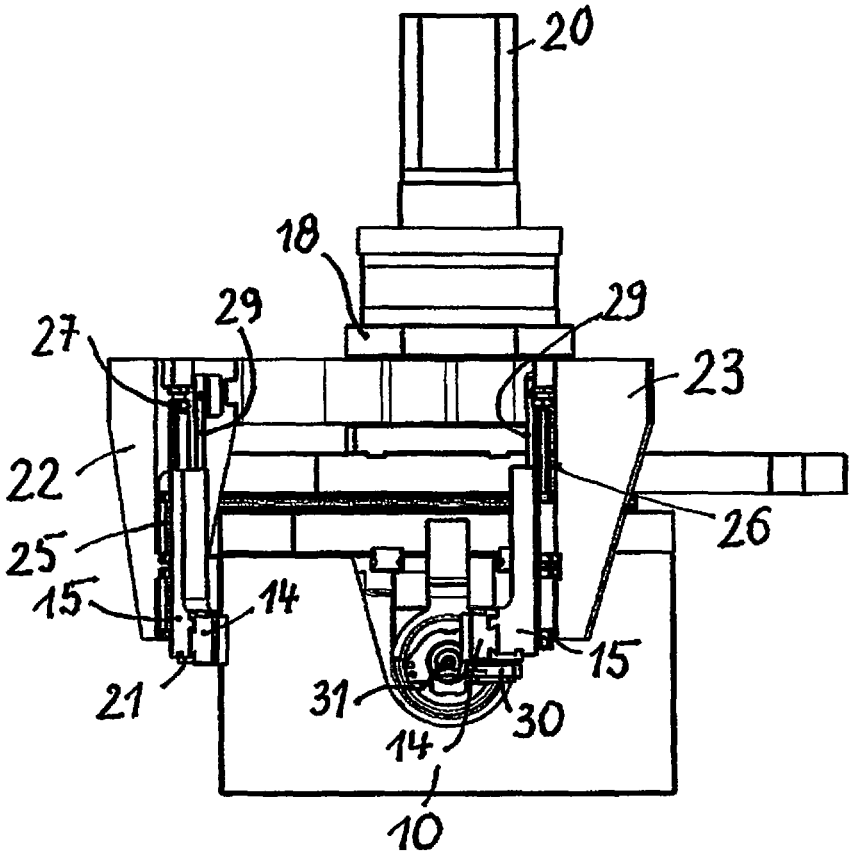

FIG. 5*a* shows the bending machine 1 in the position for right bending from the front and FIG. 5*b* shows a plan view of the lever device 12 (supporting device) in this position.

If a change is to be made from a position for left bending to the position for right bending, the bending head 11 is lowered vertically downward, then moved transversely to the longitudinal direction of the workpiece 9 and then repositioned in its new working position as shown in FIGS. 5*a* and 5*b*. The bending head 11 is moved vertically downward depending on the central axis of the workpiece 9. The lever device 12 or supporting device pivots clockwise from right to left, as seen in the feed direction of the workpiece 9, until the end position shown in FIGS. 5*a* and 5*b* is reached, in which the slide rail 14 held on the lever arm 17 for right bending can be placed laterally on the workpiece 9 and is carried along with it during the feed of the latter for carrying out the bending by friction in the transport direction, so that the support by this slide rail 14 is always realized over an equal distance on the workpiece 9.

In the exemplary embodiments shown, the arrangement of the slide rails 14 is such that they are set at an angle of 60° to each other. This angle is particularly advantageous because, on the one hand, only a relatively short distance must be covered in order to pivot from right to left bending, which can lead to a considerable reduction in non-productive times. On the other hand, however, the lever arms 16 and 17 are still sufficiently far apart at this angle to guarantee a very large bending clearance. However, a different size of the relative angle of attack of the two slide rails 14 to each other would indeed also be possible, for instance larger or smaller than 90°.

The shape of the two-arm lever 13 can be designed in any suitable way, e.g. V-shaped or C-shaped (the latter being shown in the figures).

The design of the lever device 12 according to the invention can particularly also be used advantageously for thin-walled pipes, which can also be bent without an internal mandrel. This lever device 12 can also be used to bend aluminum pipes and stainless-steel pipes without cold welding.

The bending quality is increased compared with conventional bending systems, while at the same time the unwanted non-productive times are reduced.

The invention claimed is:

1. A bending machine for bending rod-shaped or tubular workpieces, comprising:

a bending tool which includes a bending head with a bending disk, the bending disk comprising at least one circumferential bending groove extending around an axis, wherein the bending disk is configured to receive the workpiece in the bending groove selectively either on a first side of the axis or on a second side of the axis, and the bending tool further comprising a first slide rail and a second slide rail, each of which first and second slide rails has a molding groove which is configured to be placed laterally against opposing longitudinal sides of the workpiece, and a pivotably mounted, two-armed lever which is pivotable between a first pivot position and a second pivot position, wherein the first slide rail is secured to a first support part and the second slide rail is secured to a second support part, with the two support parts being mounted mirror-inverted to one another at ends of the two-arm lever, wherein each slide rail is configured to laterally support the workpiece, and is adjustable between a starting position, in which the slide rail does not rest against the workpiece, and an engagement position, in which the slide rail contacts the workpiece, wherein, in the first pivot position of the lever, the first slide rail is in the engagement position and rests laterally against the workpiece received in the bending groove on the first side of the axis and, in the second pivot position of the lever, the second slide rail is in the engagement position and rests laterally against the workpiece received in the bending groove on the second side of the axis.

2. The bending machine as claimed in claim 1, wherein the pivotably mounted lever is mounted between a workpiece guide on a machine frame and the bending tool.

3. The bending machine as claimed in claim 1, wherein the lever is pivotably mounted on a bracket which is fastened to the machine housing.

4. The bending machine as claimed in claim 1, wherein the lever is fastened to the bending head in a way that allows pivoting and horizontal movement.

5. The bending machine as claimed in claim 1, wherein the two-arm lever is V-shaped or C-shaped.

6. The bending machine as claimed in claim 1, wherein the slide rails are set at an angle of 60° to one another.

7. The bending machine as claimed in claim 1, wherein each slide rail is configured to be moved on the associated support part in parallel to the longitudinal direction of the workpiece.

8. The bending machine as claimed in claim 1, further comprising a servo motor for pivoting the lever between the first and second pivot positions.

9. The bending machine as claimed in claim 1, wherein each slide rail is seated on a tool holder which is attached to the associated support part and which in turn is configured to be moved in parallel to a longitudinal direction of the workpiece via a linear guide.

10. The bending machine as claimed in claim 9, further comprising an adjustable stop on each linear guide for defining an end position of the associated slide rail.

11. The bending machine as claimed in claim 10, wherein each slide rail is spring-reloaded in a direction of the adjustable stop.

12. The bending machine as claimed in claim 1, wherein the bending head is configured to be moved laterally and/or vertically relative to a machine frame.

13. The bending machine as claimed in claim 1, further comprising a gripper guide workpiece feeding.

14. The bending machine of claim 1, wherein the slide rails are set at an angle of 90° to one another.

15. The bending machine as claimed in claim 1, wherein the bending disk is located between ends of the pivotably mounted lever.

16. The bending machine as claimed in claim 1, wherein each slide rail is configured to laterally support the workpiece, when the slide rail is resting against the workpiece, in a region between a first point where the workpiece is tangentially fed into the bending groove of the bending disk and a second point located in a specified distance in front of the first point.

* * * * *